US007672606B2

(12) United States Patent
Imagawa et al.

(10) Patent No.: US 7,672,606 B2
(45) Date of Patent: Mar. 2, 2010

(54) METHOD FOR TRANSFER VOLTAGE ADJUSTMENT AND IMAGE FORMING APPARATUS USING THE SAME

(75) Inventors: Shinji Imagawa, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 11/888,785

(22) Filed: Aug. 2, 2007

(65) Prior Publication Data

US 2008/0038006 A1 Feb. 14, 2008

(30) Foreign Application Priority Data

Aug. 8, 2006 (JP) ..... 2006-215432

(51) Int. Cl.
*G03G 15/16* (2006.01)

(52) U.S. Cl. ..... 399/66; 399/49

(58) Field of Classification Search ..... 399/49, 399/66

See application file for complete search history.

(56) References Cited

U.S. PATENT DOCUMENTS

| | | | |
|---|---|---|---|
| 4,899,689 | A | 2/1990 | Takeda et al. |
| 6,731,889 | B2 | 5/2004 | Nakayama |
| 2006/0188277 | A1 * | 8/2006 | Nishida et al. ..... 399/49 |

FOREIGN PATENT DOCUMENTS

| | | |
|---|---|---|
| CN | 1403884 | 3/2003 |
| JP | 1-230079 | 9/1989 |
| JP | 2005-148281 | 6/2005 |
| JP | 2005-321832 | 11/2005 |

* cited by examiner

*Primary Examiner*—David M Gray
*Assistant Examiner*—Gregory H Curran
(74) *Attorney, Agent, or Firm*—David G. Conlin; Steven M. Jensen; Edwards Angell Palmer & Dodge LLP

(57) ABSTRACT

A method for transfer voltage adjustment for use in an image forming apparatus includes forming first and second halftone reference patterns, transferring the halftone reference patterns to a transfer element at respective first and second saturated transfer voltages, calculating first and second amounts of adhering toner on the transfer element, and setting up a saturated transfer voltage based on the first and second transfer voltages, the amounts of adhering toner, and a saturated amount of adhering toner obtained from stored data.

6 Claims, 5 Drawing Sheets

METHOD FOR TRANSFER VOLTAGE ADJUSTMENT AND IMAGE FORMING APPARATUS USING THE SAME

This Nonprovisional application claims priority under 35 U.S.C. §119(a) on Patent Application No. 2006-215432 filed in Japan on 8 Aug. 2006, the entire contents of which are hereby incorporated by reference.

BACKGROUND OF THE INVENTION (1) Field of the Invention

The present invention relates to a method for transfer voltage adjustment for use in a copier, multifunctional machine, printer, facsimile machine or the like as well as to an image forming apparatus using this method.

(2) Description of the Prior Art

When image forming with toner is carried out in an image forming apparatus such as a copier, multifunctional machine, printer, facsimile machine or the like, in order to keep the image density on recording media that are continuously output constant, optimal transfer conditions for keeping the amount of adhering toner on the toner image support constant are demanded.

Particularly, in a color image forming apparatus, the demanded transfer conditions are prone to change, and if the system setup deviates from the optimal transfer conditions, there occur the problems that the transfer efficiency lowers and that the quality of the output image is affected.

To deal with this, in a conventional art, in order to keep the amount of adhering toner onto the toner image support constant, a plurality of toner patches (reference patterns) are formed so that the optimal transfer conditions are set up by detecting the toner density of these patterns (see patent document 1: Japanese Patent Application Laid-open No. 2000-321832). In detecting the toner density by use of toner patches, the more the number of toner patches, the more exactly the transfer conditions can be determined.

However, when the number of toner patches is increased, there is the problem that an extra amount of toner is consumed other than that used for normal image output.

SUMMARY OF THE INVENTION

The present invention has been devised in view of the above conventional problems, it is therefore an object of the present invention to provide a method for transfer voltage adjustment capable of setting up the optimal transfer conditions by detecting the amounts of adhering toner using fewer toner patches as well as to provide an image forming apparatus using the aforementioned method.

In order to achieve the above object, the present invention is configured as follows:

The first aspect of the present invention resides in a method for transfer voltage adjustment for use in an image forming apparatus in which a toner image formed on a toner image support is transferred to a transfer element with application of a transfer voltage, comprising the steps of: forming a first halftone reference pattern on the toner image support under a first toner image forming condition; transferring the first halftone reference pattern to the transfer element at the saturated density with application of a first saturated transfer voltage thereto; calculating a first amount of adhering toner of the first halftone reference pattern on the transfer element; forming a second halftone reference pattern on the toner image support under a second toner image forming condition; transferring the second halftone reference pattern to the transfer element at the saturated density with application of a second saturated transfer voltage thereto; calculating a second amount of adhering toner of the second halftone reference pattern on the transfer element; acquiring a saturated amount of adhering toner when a density-saturated reference pattern is transferred to the transfer element at the saturated density, from previously stored data; and setting up a saturated transfer voltage for realizing the saturated amount of adhering toner, based on the first saturated transfer voltage, the first amount of adhering toner, the second saturated transfer voltage, the second amount of adhering toner and the saturated amount of adhering toner.

The second aspect of the present invention resides in a method for transfer voltage adjustment for use in an image forming apparatus in which a toner image formed on a toner image support is transferred to a transfer element with application of a transfer voltage, comprising the steps of: forming a halftone reference pattern on the toner image support under a first toner image forming condition; transferring the halftone reference pattern to the transfer element at a first unsaturated density with application of a first transfer voltage thereto; calculating a first amount of adhering toner of the halftone reference pattern that was formed with the first unsaturated density; transferring the halftone reference pattern to the transfer element at a second unsaturated density with application of a second transfer voltage thereto; calculating a second amount of adhering toner of the halftone reference pattern that was formed with the second unsaturated density; forming a saturated density reference pattern on the toner image support under a second toner image forming condition; transferring the saturated density reference pattern to the transfer element at an unsaturated density with application of a third transfer voltage thereto; calculating a third amount of adhering toner of the saturated reference pattern that was formed with the unsaturated density; acquiring a saturated amount of adhering toner when the density-saturated reference pattern is transferred to the transfer element at the saturated density, from previously stored data; and setting up a saturated transfer voltage for realizing the saturated amount of adhering toner, based on the first transfer voltage, the first amount of adhering toner, the second transfer voltage, the second amount of adhering toner, the third transfer voltage, the third amount of adhering toner and the saturated amount of adhering toner.

Here, in the present invention, the toner image support may include electrostatic latent image bearers such as photoreceptor drums and the like, and recording media such as recording paper, etc.

Also, the transfer element may include a so-called primary transfer medium which means direct transfer to a recording medium and a secondary transfer medium which means indirect transfer (intermediate transfer) to a recording medium by use of an intermediate transfer medium.

Accordingly, the present invention may employ an electrostatic latent image bearer such as, for example, a photoreceptor drum etc., as an toner image support and detect the amount of adhering toner on an intermediate transfer medium (e.g., transfer belt) on the basis of indirect transfer.

The saturated density image in the present invention may include a pattern of a so-called solid area of toner.

The third aspect of the present invention is characterized in that, in addition to the configuration described in the above first or second aspect, the saturated amount of adhering toner is acquired by using the maximum density reference value.

The fourth aspect of the present invention is characterized in that, in addition to the configuration described in any of the above first to third aspects, a single toner density sensor is used for performing calculation of the first amount of adhering toner, the second amount of adhering toner and the saturated amount of adhering toner.

The fifth aspect of the present invention is characterized in that, in addition to the configuration described in any of the above first to fourth aspects, the toner density sensor is able to detect the amount of toner remaining on the toner image support.

The sixth aspect of the present invention is characterized in that, in addition to the configuration described in any of the above first to fifth aspects, the transfer element is a recording medium to which the toner image is transferred, and the method for transfer voltage adjustment further includes the steps of: detecting the presence of the recording medium; executing the step of setting up the saturated transfer voltage when it is determined that there is no recording medium; and modifying the saturated transfer voltage, at least, in conformity with the usage environment (atmospheric temperature and/or atmospheric humidity) under which the image forming apparatus is used or in conformity with the specifications of the recording medium, i.e., whether the recording media to be used are thin paper or thick paper, and/or other possible factors.

The seventh aspect of the present invention resides in an image forming apparatus in which the method for transfer voltage adjustment according to any one of the first to fifth aspects is executed in its transfer device.

According to the first and second aspects, it is possible to set up the minimum saturated transfer voltage and provide stabilized images using, at most, two or three reference patterns with a low consumption of toner.

Further, in the present invention, when detection on the amount of adhering toner is adapted to be carried out based on an indirect transfer system in which multiple electrostatic latent image bearers such as photoreceptor drums are used as its image supports, it is possible with a single toner density detecting means to handle multiple kinds of toners for Y, M, C and K.

In accordance with the above third aspect, in addition to the effect obtained by the first or second aspect it is possible to acquire and keep a stable saturated amount of adhering toner.

In accordance with the above fourth aspect, in addition to the effect obtained by any of the first to third aspects, it is possible to use a sensor in common in a simple manner by retracting the secondary transfer roller (transfer belt), for example.

In accordance with the above fifth aspect, in addition to the effect obtained by any of the first to fourth aspects, it is possible to reduce the influence by remaining toner after the secondary transfer.

In accordance with the above sixth aspect, in addition to the effect obtained by any of the first to fifth aspects, it is possible to determine a more exact transfer voltage.

For example, it is possible to achieve more stabilized image forming by setting the transfer voltage at the normal level (100%) for plain paper and modifying the level to 10% higher (110%) for thick paper in a low temperature and low humidity environment and by modifying the transfer voltage to 20% higher (120%) for plain paper and 30% higher (130%) for thick paper in a high temperature and high humidity environment.

In accordance with the above seventh aspect, it is possible to set up the optimal transfer voltage with a low consumption of toner, hence provide stable images.

DESCRIPTION OF THE PREFERRED EMBODIMENTS

The embodiment of the present invention will hereinafter be described in detail with reference to the accompanying drawings.

Figure 1:
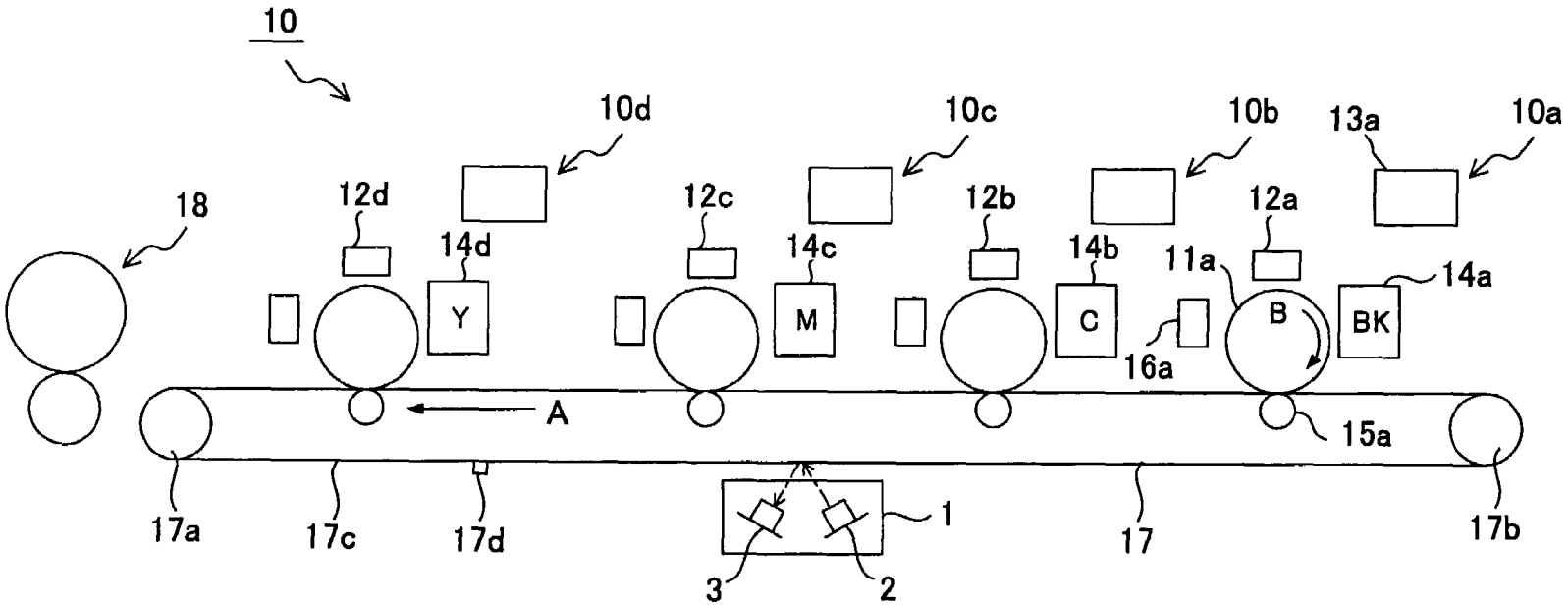
FIG. 1 is a schematic diagram showing a configuration of an image forming portion of an image forming apparatus in which a method for transfer voltage adjustment according to the present invention is carried out.

FIG. 1 is a schematic diagram showing a configuration of an image forming portion of an image forming apparatus in which an image forming method according to the present invention is carried out.

It should be noted that this invention can be similarly applied to other types of image forming apparatus such as printers, facsimile machines etc., which performs electrophotographic image forming, other than the above image forming apparatus.

As shown in FIG. 1, the image forming apparatus according to the present embodiment reads a color image from a document with a scanner portion (not shown), effects predetermined image processes over the image, then supplies it as image data to an image forming portion 10, to thereby reproduce the color image that was picked up from the document onto a recording medium such as paper or the like.

The aforementioned image forming portion 10 includes a transfer and conveyance belt (transfer element) 17 that is wound and stretched between a pair of rollers 17*a* and 17*b* with its top and bottom kept horizontal, and is rotated in a direction of arrow A. The top part of transfer and conveyance belt 17 moves horizontal by its rotation in the direction of arrow A and conveys the paper (recording medium) placed thereon sequentially along, and opposite to, multiple image forming stations 10*a* to 10*d*. Image forming stations 10*a* to 10*d* each effect electrophotographic image forming with black and the three subtractive primary colors (cyan, magenta and yellow), respectively.

The transfer and conveyance belt 17 opposes a density detecting sensor (toner density sensor) 1 when the belt are passing through the bottom horizontal part. A reference position mark 17*d* that is detectable by density detecting sensor 1 is formed on a part of a toner image-transferred surface 17*c* of transfer and conveyance belt 17 on which toner images are formed.

Further, a fixing device 18 is arranged on the downstream side of roller 17*a* at one end of transfer and conveyance belt 17. Fixing device 18 is formed of a pair of rollers so as to fuse the toner image that was transferred on the paper and fix it to the paper surface by heating and pressing the paper that has passed through all image forming stations 10*a* to 10*d*.

Image forming stations 10*a* to 10*d* all have identical configurations except for the amount of stored toner. As one example, image forming station 10*a* has a photoreceptor drum (toner image support) 11*a* that is formed of a cylindrical conductive base and a photoconductive layer formed thereon and rotates in a direction of arrow B, and further includes a charger 12*a*, an exposure unit 13*a*, a developing unit 14*a*, a transfer device 15*a*, a cleaner 16*a* and others, all being arranged around the photoreceptor drum in the order mentioned.

Photoreceptor drum 11*a* is formed of a cylindrical conductive base made of aluminum or the like and a photoconductive layer (to be referred to simply as "photoreceptor") formed on the surface thereof by coating.

Charger 12*a* uniformly applies electricity of a predetermined polarity over the photoreceptor drum 11*a* surface.

Exposure unit 13*a* forms an electrostatic latent image by irradiating an image of light over the photoreceptor drum 11*a* surface.

Developing unit 14*a* supplies the toner stored therein to the photoreceptor drum 11*a* surface so as to visualize the electrostatic latent image into a toner image.

Transfer device 15*a* is arranged opposing the outer peripheral surface of photoreceptor drum 11*a* with transfer and conveyance belt 17 in-between so as to transfer the toner image formed on the photoreceptor drum 11*a* surface to the paper placed on transfer and conveyance belt 17.

Transfer device 15*a* is, for example a roller member including a metal shaft element and a conductive layer covering the metal shaft surface. The shaft element is made of, for example a metal such as stainless steel or the like. The conductive layer is formed of a conductive elastic material or the like. As a conductive elastic material, those usually used in this field can be used; for example EPDM (ethylene propylene), foamed EPDM, foamed urethane and the like containing conductive material such as carbon black or the like can be listed.

Cleaner 16*a* removes the toner residing on the peripheral surface of photoreceptor drum 11*a* after completion of the transfer step.

Developing unit 14*a* includes a developing roller that rotates opposing the peripheral surface of photoreceptor drum 11*a*.

Figure 2:
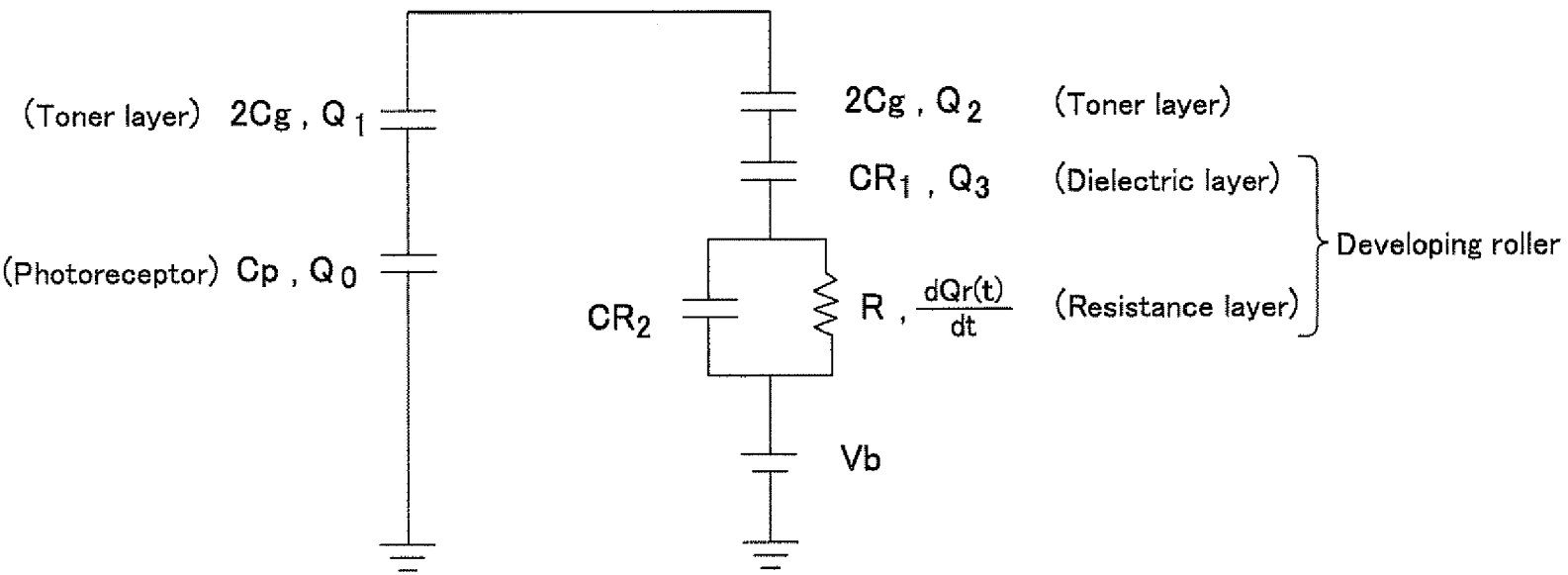
FIG. 2 is an illustrative diagram showing an electric relationship between a developing roller and a photoreceptor drum in the image forming portion of the image forming apparatus.

The developing roller is comprised of a conductive support (e.g., stainless steel, conductive resin or the like), a conductive elastic material layer made of an elastic material having electric resistance and a dielectric material layer (dielectric layer) laminated over the peripheral surface of the conductive elastic material layer. The conductive support and conductive elastic material layer will be mentioned hereinbelow as a resistance layer R (FIG. 2). A developing bias voltage $V_B$ (FIG. 2) is applied to the conductive support.

The developing roller carries toner on its surface and supplies the toner to the photoreceptor drum 11*a* surface as it rotates. When the peripheral speed of this developing roller, or its rotational speed is changed, the supplied amount of toner to the peripheral surface of photoreceptor drum 11*a* can be varied so as to adjust the toner image density.

Supplied to exposure units 12*a* to 12*d* provided for image forming stations 10*a* to 10*d* are color image data of black, cyan, magenta and yellow, respectively while developing units 14*a* to 14*d* each hold a toner of corresponding color, i.e., black, cyan, magenta or yellow. Accordingly, image forming stations 10*a* to 10*d* sequentially transfer respective colors of toner images, i.e., black, cyan, magenta and yellow images, to a sheet of paper, so as to create a full color image on the paper passing through fixing unit 18 by subtractive color mixture of the toner images of individual colors.

A toner patch (reference pattern) as the reference pattern for high density correction is formed with black toner on toner image-transferred surface 17*c* of transfer and conveyance belt 17 when an image correcting process is carried out.

Density detecting sensor 1 employs a reflection sensor having a light emitting element 2 and a light receiving element 3, and emits light from light emitting element 2 onto toner image-transferred surface 17*c* of transfer and conveyance belt 17 and receives by light receiving element 3 the reflected light that is directly reflected from toner image-transferred surface 17*c* and the toner patch and outputs an electric signal corresponding to the received light intensity as a detected signal of toner density.

This density detecting sensor 1 may be adapted to detect not only the toner patch for high density correction but also the toner density of toner patches as the reference patterns for optimizing the transfer process, or may be adapted to detect (calculate) based on the above detected result the amount of toner remaining on transfer and conveyance belt 17.

The toner patches formed on the transfer and conveyance belt 17 surface are removed from the transfer and conveyance belt 17 surface by an unillustrated cleaning means after opposing, and passing by, density detecting sensor 1.

Alternatively, the present invention can be also applied to a configuration in which density detecting sensor 1 is arranged at a position opposing the photoreceptor drum 11*a* surface on the downstream of the developing stage in each of image forming stations 10*a* to 10*d* so as to detect the density of the toner patch before it is transferred to transfer and conveyance belt 17.

Now, toner's development characteristic and toner's transfer characteristic will be described.

Here, the following relational expressions are determined based on the contents in the following publications 1 to 4.

Publication 1: Japan Hardcopy '89 collection of academic papers EP-7 Jul. 5-7, 1989 the Society of Electrophotography of Japan, pp. 25-28;

Publication 2: Bulletin of the Society of Electrophotography of Japan, Vol. 28, No. 1 (1989), p. 120;

Publication 3: Japan Hardcopy '88 the 61st Investigation Forum of the Society of Electrophotography of Japan EP-33 May 16-18, 1988, pp. 131-134; and, Publication 4: Bulletin of the Society of Electrophotography of Japan, Vol. 31, No. 4 (1992), p. 20.

To begin with, toner's development characteristic will be described using an equivalent model of a configuration including a photoreceptor, a developing roller and toner, with reference to FIG. 2.

In this equivalent model the following are assumed:

a) The materials (the layers of the developing roller) constituting the developing roller have linear electric characteristics.

b) Toner is supported on the developing roller surface as a thin layer and has electric charge Qt.

c) The developing roller is made of two layers, namely a dielectric layer as the top surface and a resistance layer as the bottom layer.

d) Electric charge $Qt_0$ of a polarity opposite to that of the toner exists on the developing roller surface.

e) It is long enough from electrification of the toner to development, so that electric charge, $-(Qt+Qt_0)$ is injected into the boundary between the dielectric layer and resistance layer of the developing roller.

f) The photoreceptor drum and the developing roller are put in contact with each other with a constant nip width and the line speed ratio therebetween kept constant, and the toner gains electric charge ΔQt from its friction with the photoreceptor drum during passage of the nip.

g) Toner's electric charge ($Qt+Qt_0$) is assumed to reside at the center of the toner layer. The toner layer is regarded as a pair of capacitors connected at that center.

The capacitances of the photoreceptor, the toner layer, the dielectric layer of the developing roller and the conductive elastic material layer of the developing roller are represented by $C_p$, $C_g$, $CR_1$ and $CR_2$, respectively.

Further, the amounts of static charge on the photoreceptor, the toner layer on the photoreceptor side, the toner layer on the developing roller side and the developing roller are represented by $Q_0(t)$, $Q_1(t)$, $Q_2(t)$ and $Q_3(t)$, respectively.

Moreover, the amount of electricity moving to the photoreceptor drum through the resistance layer of the developing roller is represented by Qr(t).

When capacitance $CR_2$ of the conductive elastic material layer of the developing roller is so low as to be negligible, the voltage equilibrium condition of the equivalent model in FIG. 2 can be written down as the following equation (1).

$$\frac{Q_0(t)}{C_p}+\frac{Q_1(t)}{2C_g}+\frac{Q_2(t)}{2C_g}+\frac{Q_3(t)}{CR_1}+R\frac{dQr(t)}{dt}+V_B=0 \tag{1}$$

where $d_p(m)$ represents the thickness of the photoreceptor, $\epsilon_p$ the relative dielectric constant of the photoreceptor, $d_t(m)$ the thickness of the toner layer, $\epsilon t$ the relative dielectric constant of the toner layer, $C_p=\epsilon_p/d_p$, $C_g=\epsilon_t/d_t$, and $V_B$ represents the developing bias.

Here, the initial conditions $Q_0(0)$, $Q_1(0)$, $Q_2(0)$ and $Q_3(0)$ for the amounts of static charge $Q_0(t)$, $Q_1(t)$, $Q_2(t)$ and $Q_3(t)$ satisfy the following equations (2) to (5).

$$-Q_0(0)+Q_1(0)=Q_p-\Delta Q_t \tag{2}$$

$$-Q_1(0)+Q_2(0)=Q_p+\Delta Qt \tag{3}$$

$$-Q_2(0)+Q_3(0)=Qt_0 \tag{4}$$

$$-Q_3(0)+Q_4(0)=-Qt-Qt_0 \tag{5}$$

From the above equations (2) to (5), the following expressions can be obtained.

$$Q_0(0)=-Q_p+Q_1(0)+\Delta Qt,\ Q_0(0)'=Q_1(0)+\Delta Qt$$

$$Q_1(0)=Q_0(0)+\Delta Qt$$

$$-Q_1(0)+Q_2(0)=Qt+\Delta Qt,$$

$C_1=2C_g$, $C_2=2C_g$, and from the above equation (3), the following relations hold.

$$Q_2(0)=(Qt+\Delta Qt)/2$$

$$Qt_0=-Qt$$

$$Q_3(0)=(Qt+\Delta Qt)/2$$

As the amount of moving electricity, Qr(t) is determined considering the initial conditions, the following equation (6) can be obtained.

$$Qr(t)= \tag{6}$$

-continued $$\left(V_B-V_p-\left[\frac{Q_0(0)'}{C_p}+\frac{Q_3(0)'}{CR_1}\right]\right)\cdot\frac{1}{\frac{1}{C_p}+\frac{1}{C_g}+\frac{1}{CR_1}}\cdot\left(1-\exp\left[\frac{-t}{\tau}\right]\right)$$

where $$\tau=\frac{1}{\frac{1}{C_p}+\frac{1}{C_g}+\frac{1}{CR_1}}\cdot R$$

Separation (disconnection) of a toner layer from the developing roller takes place instantly at the position where the electric field in the toner layer is equal to 0. The condition for disconnection of the toner layer when the simplified thickness of the toner layer before development is represented as $d_t(m)$ is given as the following equation (7).

$$\frac{Q_0}{C_p}+\frac{Q_1}{C_{g1}}=V_B-\frac{dQ_1}{dt}\cdot R+\frac{Q_2}{C_{g2}} \tag{7}$$

Here, the boundary conditions at the toner layer disconnection (t=Td) are given as follows:

$$Q_0(0)=-Q_p-Q_1(0)-\Delta Qt+Qr(Td)$$

$$Q_0'=-Q_p-\Delta Qt+Qr(Td)$$

$$Q_1=-Q_0+\Delta Qt-Qr(Td)$$

$-Q_1+Q_2=Qt+\Delta Qt$, and from the above equation (3), the following equations are obtained.

$$Q_2=(Qt+\Delta Qt)/2+Qr(Td)$$

$$Qt_0=-Qt$$

$$Q_3=(Qt+\Delta Qt)/2+Qr(Td)$$

Then $Q_0$ can be expressed as $$Q_0=Qp+Q_1-\Delta Qt$$

Further, considering the boundary conditions and $V_1=Q_1/(2\,Cg_1)$ and $V_2=Q_2/(2\,Cg_2)$, the following equation (8) can be obtained.

$$Q_1\cdot\left[\frac{1}{C_p}+\frac{1}{C_g}+\frac{1}{CR_1}+R\right]=V_B-\frac{Q_0'}{C_p}+N\cdot V_t+Qr(Td)\cdot R \tag{8}$$

Here, the following relations are given:

toner layer voltage $$V_t=\frac{2\rho_t\cdot d_t^2}{2\varepsilon_t},$$

photoreceptor surface potential $$V_p = \frac{Q_p}{C_p},\ C_{g1} = \frac{x}{2\varepsilon_t}\cdot N,\ C_{g21} = \frac{(d_t - x)}{2\varepsilon_t}\cdot N_t,$$

and $\overline{X} = x \cdot N$

From these relations, $\overline{X}$ can be obtained as the following equation (9).

$$\overline{X} = \frac{[V_B + (V_t - \Delta V_t)\cdot N - (V_p - \Delta V_p)]}{(\rho + \Delta\rho)\left[\frac{1}{C_p} + \frac{1}{C_g} + \frac{1}{CR_1} + R\right]} \tag{9}$$

In equation (9), when it is assumed that $\Delta V_t=0$, $\Delta V_p=0$, R=0, toner's specific weight $\gamma=m_o/d_t$, the amount of static charge qpm(C/Kg) is equal to $\rho_t/\gamma$, and the following equation (10) is obtained. Here, $m_o$ is the amount of supplied toner to the developed area.

$$\overline{X} = \frac{\left[\frac{(V_B - V_p)}{qpm\cdot\gamma} + \frac{\frac{m_o}{\gamma}}{2\varepsilon}\cdot d_t\cdot N\right]}{\left[\frac{1}{C_p} + \frac{1}{C_g}\right]} \tag{10}$$

Accordingly, the amount of adhering toner (the amount of development) mp that is used for development on the photoreceptor can be given as follows:

$$mp = \overline{X\cdot\gamma} = \frac{\left[\frac{(V_B - V_p)}{qpm} + \frac{m_o}{2\varepsilon}\cdot d_t\cdot N\right]}{\left[\frac{1}{C_p} + \frac{1}{C_g}\right]} \tag{11}$$

or $$mp = \overline{X\cdot\gamma} = \frac{[(V_B - V_p) + V_t\cdot N]}{qpm\left[\frac{1}{C_p} + \frac{1}{C_g}\right]} \tag{11'}$$

where toner layer voltage $V_t$ is expressed as $$Vt = qpm\cdot\frac{m_o}{2\varepsilon}\cdot d_t$$

From these equations, it is understood that mp, the amount of adhering toner developed on the photoreceptor drum, is proportional to the potential difference ($V_B-V_p+V_t\cdot N$) of the photoreceptor drum surface potential $V_p$, developing bias $V_B$ and toner layer potential $V_t\cdot N$.

When a halftone toner patch image is formed, with developing bias $V_B$ fixed at a predetermined potential level, the surface potential $V_p$ of the photoreceptor drum is controlled based on the exposure condition so as to realize the predetermined amount of adhering toner, mp.

The equation for the development characteristic thus determined can be written as $$V_p+V_d=V_B+NV_t-V_d$$

where, of the potential of the toner layer $V_t\cdot N$, the potential of the toner that is developed on the photoreceptor drum having a surface potential of $V_p$ is represented as a developed toner voltage $V_d$. The developed toner potential on the photoreceptor (the surface potential of the photoreceptor drum) $V_p$ for gaining developed toner voltage $V_d$ is given as the following equation (A).

$$V_p=V_B+NV_t-2V_d \tag{A}$$

Next, the toner's transfer characteristic will be described.

The toner's transfer characteristic can be determined in a manner similar to how the above development characteristic is determined. That is, the transfer characteristic can be obtained by determining a position X at which the electric field in the toner layer becomes equal to 0, or the position at which the voltage on the photoreceptor drum side and the voltage on the transfer roller side become equal to each other, taking the boundary conditions and other factors into consideration.

Figure 3:
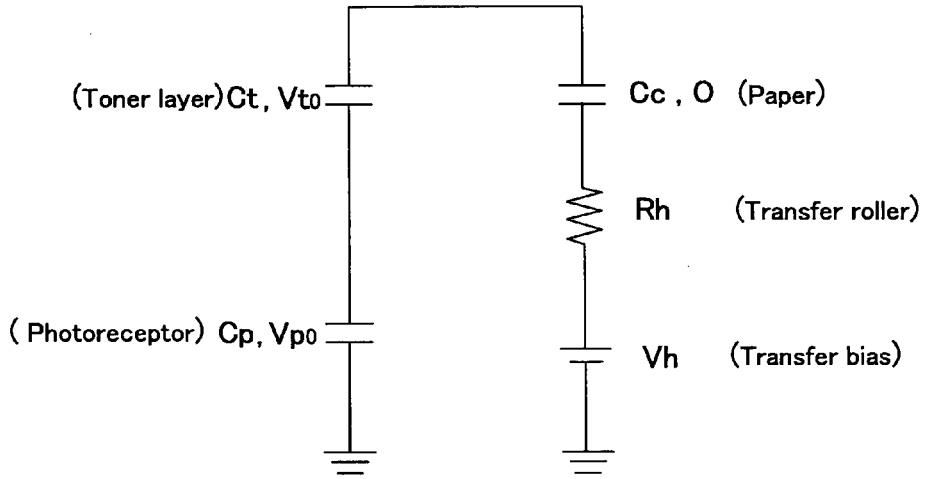
FIG. 3 is an illustrative diagram showing an electric relationship between a photoreceptor drum and a transfer medium in the image forming portion of the image forming apparatus.
Figure 4:
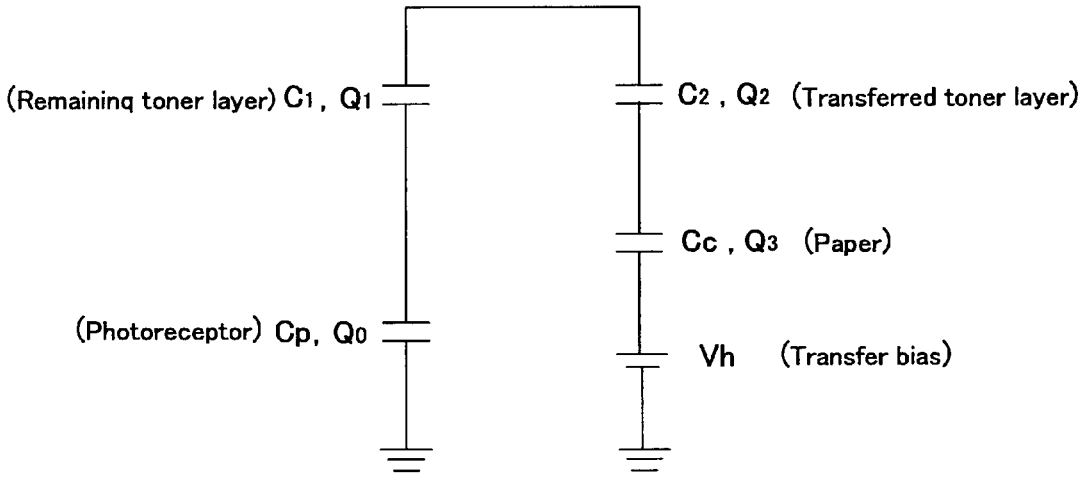
FIG. 4 is an illustrative diagram showing an electric relationship between a photoreceptor drum and the toner transferred to a recording medium in the image forming portion of the image forming apparatus.

FIG. 3 shows an equivalent model before the toner layer transfers from the photoreceptor drum to the paper, and FIG. 4 shows an equivalent model after the toner layer has transferred from photoreceptor drum to the paper.

In FIG. 3, the capacitance and the surface potential of the photoreceptor drum before transfer are represented as $C_p$ and $V_{p0}$. Also, the capacitance and the surface potential of the toner layer on the photoreceptor drum before transfer are represented as, $C_t$ and $V_{t0}$. $C_c$ and O represent the capacitance and the surface potential of the paper before transfer. The electric resistance of the transfer roller and the transfer bias are represented as $R_h$ and $V_h$.

In FIG. 4, the amount of static charge on the photoreceptor after transfer is represented as $Q_0$. The capacitance and the amount of static charge of the remaining toner layer on the photoreceptor after transfer are represented as $C_1$ and $Q_1$. The capacitance and the amount of static charge of the toner layer transferred to the paper are represented as $C_2$ and $Q_2$. The amount of static charge on the paper after transfer is represented as $Q_3$.

In the equivalent models shown in FIGS. 3 and 4, the conditions of the components are designated as follows:

photoreceptor drum's thickness: $d_p$(m);

toner layer's thickness: $d_t$(m);

transfer medium (copy paper)'s thickness: $d_c$(m);

photoreceptor drum's relative dielectric constant: $\epsilon_p$;

relative dielectric constant of the toner layer: $\epsilon_t$;

transfer medium's relative dielectric constant: $\epsilon_c$;

resistance of the transfer roller per unit area: $R_r$ ($\Omega m^2$);

and transfer bias: $V_h$(v).

As $\rho(C/m^3)$ represents the charge density per unit thickness of the toner, $\epsilon_t$(F/m) represents the dielectric constant, $d_t$(m) represents the thickness of the toner layer directly before it enters the transfer region, and x(m) represents the thickness of the toner layer on the transfer medium when the toner layer is disconnected, the condition for disconnection of the toner layer can be represented by the following equation in the equivalent model in FIG. 4 if the voltage drop across the transfer roller is negligible.

$$\frac{Q_0}{C_P} + \frac{Q_1}{C_1} = \frac{Q_2}{C_2} + \frac{Q_3}{C_C} + V_h$$

$$C_P = \varepsilon_0\cdot\varepsilon_P\frac{1}{d_P},\ C_C = \varepsilon_0\cdot\varepsilon_C\frac{1}{d_C},\ \varepsilon_0 = 8.855\times10^{-12}$$

Here, when ρ represents the toner's charge density and Δρ represents the variation of charge density due to reversal electrification, $$Q_t=\rho\cdot d_t$$

$$\Delta Q_t=\Delta\rho\cdot d_t$$

and the boundary conditions upon disconnection when the toner layer departs from the transfer area are given as follows:

$$Q_{20}=\rho_t\cdot x,\ C_2=x/2\epsilon_t$$

$$Q_{10}=\rho_t\cdot(d_t-x),\ C_1=(d_t-x)/2\epsilon_t$$

$$Q_0=-Q_p+\Delta Q_t+Q_{20}-\Delta Q_{t2}$$

$$Q_1=-Q_{10}+\Delta Q_{t1}$$

$$Q_2=-Q_{20}+\Delta Q_{t2}$$

$$Q_3=-Q_{20}+\Delta Q_t$$

$$Q_1+Q_2=-Q_t+\Delta Q_t$$

$$Q_{10}+Q_{20}=Q_t$$

$$\Delta Q_t=\Delta Q_{t1}+\Delta Q_{t2}$$

$$\Delta Q_{t1}=\Delta Q_t\cdot(d_t-x)/d_t$$

$$\Delta Q_{t2}=\Delta Q_t\cdot x/d_t$$

When the above equation is solved for x, using the relations:

$$V_t-\Delta V_t=(\rho_t-\Delta\rho_t)\cdot d_t^2/2\epsilon_t \quad \text{(a)}$$

$$V_p=Q_p/C_p \quad \text{(b)}$$

and on the assumption that the influence of reversal electrification of the transfer medium can be neglected since it is small compared to those of the photoreceptor and the toner layer, x is given as follows:

$$x=\frac{[V_h-(V_P-\Delta V_P)+(V_t-\Delta V_t)]}{(\rho-\Delta\rho)\left[\frac{1}{C_P}+\frac{1}{C_t}+\frac{1}{C_3}\right]} \quad \text{(c)}$$

where $$V_p-\Delta V_p=(Q_p-\Delta Q_t)/C_p$$

$$V_t-\Delta V_t=(Q_t-\Delta Q_t)/C_t$$

$$\Delta\rho=\Delta Q_t/d_t$$

When the terms originating from reversal electrification are omitted, x is given as follows:

$$x=\frac{[V_h-V_p+V_t]}{\rho\left[\frac{1}{C_p}+\frac{1}{C_t}+\frac{1}{C_3}\right]}$$

The amount of toner M that transfers to the transfer medium is obtained by multiplying x with the toner's specific weight γ, $$M=\gamma\cdot x$$

Thus, from the equations (a), (b) and (c), the transfer characteristic (the transfer bias vs. the amount of transferred and adhering toner) for the toner bearing an arbitrary amount of static charge qpm(C/kg) in consideration of reversal electrification can be determined.

The method for transfer voltage adjustment according to the present invention is carried out based on the above-described toner' development characteristic and transfer characteristic.

The First Embodiment

The first embodiment of the method for transfer voltage adjustment according to the present invention will be described with reference to the drawings.

Figure 5:
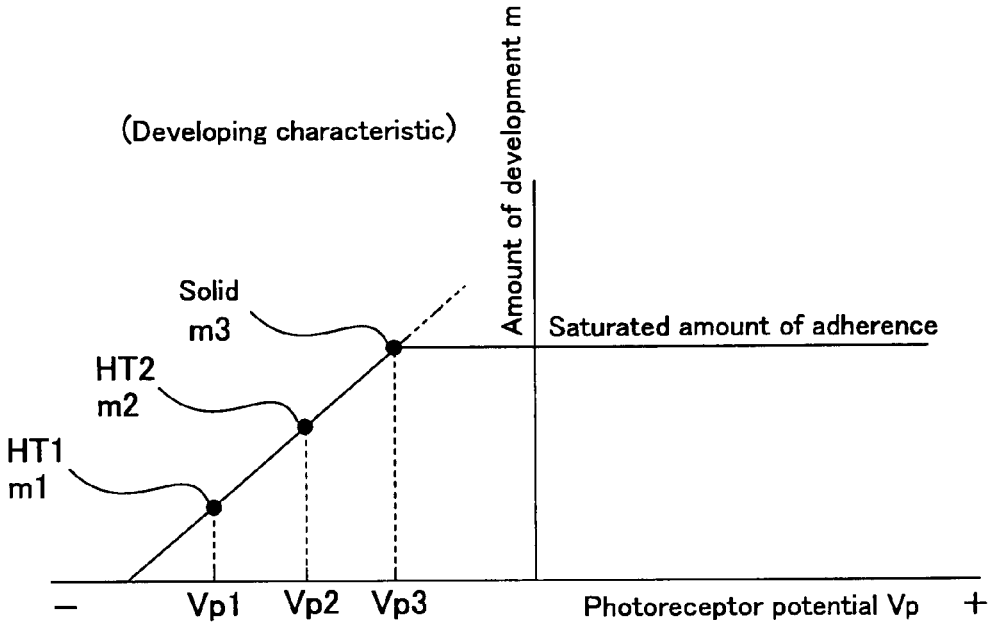
FIG. 5 is an illustrative chart showing a line segment approximation that represents the relationship between the amount of developed toner and the photoreceptor potential in the method for transfer voltage adjustment according to the first embodiment.
Figure 6:
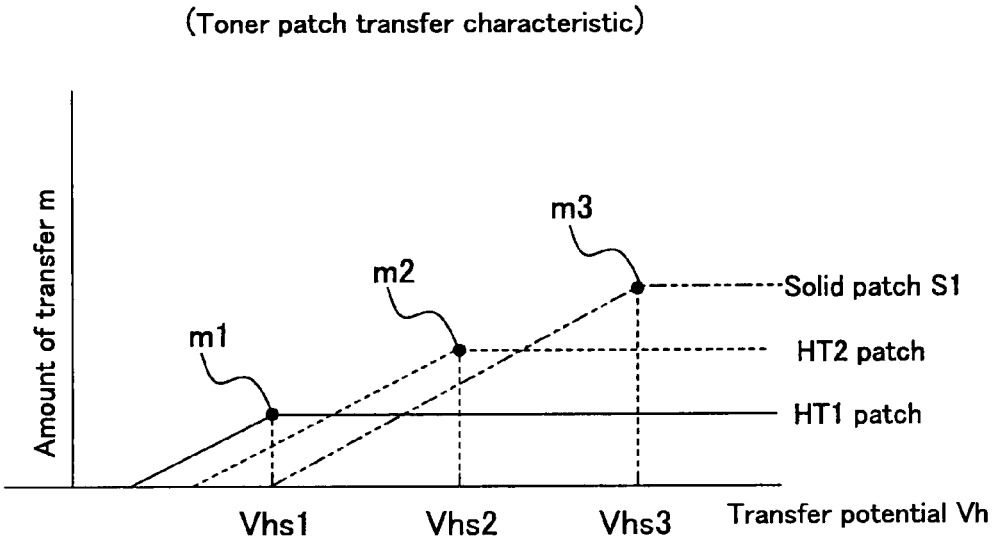
FIG. 6 is an illustrative chart showing a line segment approximation that represents the relationship between the amount of transferred toner and the transfer potential in the same method for transfer voltage adjustment.

FIG. 5 is an illustrative chart showing a line segment approximation that represents the relationship between the amount of developed toner and the photoreceptor potential in a method for transfer voltage adjustment according to the present embodiment, and FIG. 6 is an illustrative chart showing a line segment approximation that represents the relationship between the amount of transferred toner and the transfer potential in the method for transfer voltage adjustment.

FIG. 5 shows the states where first and second halftone patches HT1 and HT2 (which may be abbreviated as "patches HT1 and HT 2" in some cases) and a solid toner patch S1 (which may be abbreviated as "patch S1" in some cases) are formed on the photoreceptor under the first to third toner image forming conditions, respectively.

Patch HT1 that was formed under the first toner image forming condition has a first amount of developed toner m1 with a photoreceptor potential $Vp_1$. Patch HT2 that was formed under the second toner image forming condition has a second amount of developed toner m2 with a photoreceptor potential $Vp_2$. Patch S1 that was formed under the third toner image forming condition has a third amount of developed toner m3 with a photoreceptor potential $Vp_3$.

Here, "solid" indicates a print having no gaps. A "solid toner patch" indicates a developed toner area of a predetermined contour shape which is filled with toner without any gap (the predetermined contour shape is occupied 100% with toner). When this "solid toner patch" is detected by density detecting sensor 1, the detection presents the maximum density because toner exists inside the predetermined contour shape (area) without any gap.

"Halftone" indicates a print having gaps such as dots, a mesh and the like. A "halftone toner patch" indicates a developed toner area of a predetermined contour shape in which tiny dots or meshes of toner are printed with gaps (the predetermined contour shape is occupied less than 100% with toner). When this "halftone toner patch" is detected by density detecting sensor 1, the detection presents a density value lower than the maximum density because gaps without toner exist inside the predetermined contour shape.

In this application, the maximum density is also mentioned as "saturated density", a density value lower than the maximum density is also referred to as "unsaturated density".

In the present embodiment, when $V_p$ represents the photoreceptor surface potential, $V_d$ represents the potential of the developed toner on the photoreceptor drum, $V_c$ represents the transferred toner potential and $V_h$ represents the transfer bias, the condition for disconnection can be expressed as follows.

That is, $$V_p+V_d-V_c=V_h+V_c \quad \text{(B)}$$

Substituting (A) into equation (B), the following relation is obtained:

$$V_h=(V_B+NV_t-2\cdot V_d)+V_d-2\cdot V_c$$

To determine the saturated transfer potential $V_{hs}$ above which the amount of transferring toner will not increase, $V_d=V_c$ holds at the time of saturation, $V_{hs}$ can be given as follows:

$$V_{hs}=V_B+NV_t-3\cdot V_d \quad \text{(C)}$$

"Saturation of the amount of transfer (saturated transfer)" indicates that all the developed toner on the photoreceptor transfers to the transfer material side. Accordingly, in the case of saturated transfer of a solid toner patch, the toner patch having the saturated density totally transfers to the transfer material. In the case of saturated transfer of a halftone toner patch, the toner patch having an unsaturated density totally transfers to the transfer material.

"Saturated transfer potential" indicates the transfer potential at the time of saturated transfer. For the "saturated transfer potential", there are two levels, the saturated transfer potential of a toner patch having a saturated density and the saturated transfer potential of a toner patch having an unsaturated density.

A transfer of which the amount of transferring toner does not reach the saturated level is called "unsaturated transfer". The transfer potential at the time of a "unsaturated transfer" is called "unsaturated transfer potential". When unsaturated transfer of a solid toner patch and halftone toner patch is carried out, the toner-occupied area inside the predetermined contour shape of the transferred toner patch becomes smaller than that inside the predetermined contour shape on the photoreceptor. When a solid toner patch that was transferred by an "unsaturated transfer" process, is detected by density detecting sensor 1, the detection presents a density value lower than the maximum density (unsaturated density).

As shown in FIG. 6, when the amounts of development of patches HT1 and HT2 are m1 and m2 and the amount of development of saturated density (solid) patch S1 is m3, saturated transfer potentials $V_{hs1}$, $V_{hs2}$ and $V_{hs3}$ for these are as follows:

$$V_{hs1}=V_B+NV_t-3\cdot V_{d1}$$

$$V_{hs2}=V_B+NV_t-3\cdot V_{d2}=V_B+NV_t-3\cdot V_{d1}(m2/m1), \text{ hence}$$

$$V_{d1}=(V_{hs1}-V_{hs2})\cdot m1/(m1-m2)$$

Saturated transfer potentials $V_{hs1}$, $V_{hs2}$ and $V_{hs3}$ are the threshold levels of the corresponding saturated transfer potentials, at which the potential level changes from the unsaturated transfer potential to the saturated transfer potential, or in other words, the minimum saturated transfer voltages.

Saturated transfer potential $V_{hs3}$ for the amount of saturated density development, m3 is given as follows.

$$V_{hs3}=V_B+NV_t-3\cdot V_{d3}=V_B+NV_t-3\cdot V_{d1}(m3/m1)$$

where $V_{d1}=(V_{hs1}-V_{hs2})\cdot m1/(m1-m2)$

When $V_p$ is nearly equal to zero by virtue of transfer charge erasure, the above (B) can be rewritten as $$V_d-V_c=V_h+V_c \quad \text{(D)}$$

hence $$V_h=V_d-2\cdot V_c$$

When $V_{hs}$, the transfer potential when the amount of transferred toner saturates is determined, since $V_d=V_c$ holds at the time of saturation, the following equation (E) is obtained.

$$V_{hs}=-V_d \quad \text{(E)}$$

The saturated transfer potentials $V_{hs1}$ and $V_{hs2}$ for first and second amounts of development of the halftone patches, m1 and m2, can be given as $$V_{hs1}=-V_{d1}$$

$$V_{hs2}=-V_{d2}=-V_{d1}(m2/m1)$$

hence the following equation is obtained.

$$V_{d1}=(V_{hs1}-V_{hs2})\cdot m1/(m1-m2)$$

The saturated transfer potential $V_{hs3}$ for m3, the amount of saturated density development is determined by the following equation (F).

$$V_{hs3}=-V_{d3}=-V_{d1}(m3/m1) \quad \text{(F)}$$

where $V_{d1}=(V_{hs1}-V_{hs2})\cdot m1/(m1-m2)$

Now, the steps for determining the minimum saturated transfer potential $V_{hs3}$ for m3, the amount of saturated density development will be described.

To begin with, first halftone patch HT1 is formed on photoreceptor drum 11*a* under the first toner image forming condition (Step 1).

Then, transfer of first patch HT1 on photoreceptor drum 11*a* to transfer and conveyance belt 17 is performed with saturated transfer voltage (preferably minimum saturated transfer voltage) $V_{hs1}$ applied to the belt so that all the toner of the patch will transfer (saturated transfer) to the belt (Step 2).

The first patch HT1 on transfer and conveyance belt 17 is detected by density detecting sensor 1 (FIG. 1). Based on the detected result, m1, the amount of development (amount of adhering toner) of first patch HT1, is calculated (Step 3).

Similarly, second halftone patch HT2 is formed on photoreceptor drum 11*a* under the second toner image forming condition (Step 4).

Then, transfer of second patch HT2 on photoreceptor drum 11*a* to transfer and conveyance belt 17 is performed with saturated transfer voltage (preferably minimum saturated transfer voltage) $V_{hs2}$ applied to the belt so that all the toner of the patch will transfer to the belt (Step 5).

The second patch HT2 on transfer and conveyance belt 17 is detected by density detecting sensor 1, and based on the detected result, m2, the amount of development (amount of adhering toner) of second patch HT2 is calculated (Step 6).

As to solid patch S1, no actual development onto the photoreceptor is performed, and the amount of development m3, which is determined beforehand, is used. For example, the amount of development, m3 can be calculated, for example, based on the maximum density reference value stored for solid patch density correction (Step 7).

The order of the above steps is not limited. If some steps can be executed in parallel, they can be processed in parallel.

By substituting the amounts of development, m1 to m3, determined from the above process and the saturated transfer voltages (preferably, minimum saturated transfer voltages) $V_{hs1}$ and $V_{hs2}$, into the above expression (F), the minimum saturated transfer potential $V_{hs3}$ for transferring all the toner of saturated density, i.e., the amount of development m3. The thus obtained minimum saturated transfer potential $V_{hs3}$ is the minimum transfer potential for implementing saturated transfer of the amount of development m3, that is, the suitable transfer potential.

As described above, it is possible to determine the minimum saturated transfer potential $V_{hs3}$ for m3, the amount of saturated density development, from two halftone saturated transfer potentials (preferably the minimum saturated transfer voltages) $V_{hs1}$ and $V_{hs2}$ for two halftone patches with first and second amounts of development, m1 and m2 even if pre-transfer charge erasing was performed. Accordingly, it is possible to avoid application of a wasteful saturated transfer potential.

As described heretofore, according to the present embodiment, since the minimum saturated transfer potential for the toner patch of saturated density can be set up using two toner patches as the reference patterns, it is possible to determine the suitable transfer voltage with a lower amount of toner. As a result, it is possible to provide stable toner images by use of the optimal transfer voltage without consumption of wasted toner.

Though the first embodiment was described referring to a case in which two kinds of halftone patches HT1 and HT2 that are developed under first and second toner image forming conditions, respectively are prepared, the present invention should not be limited to this. That is, it is also possible to determine the saturated transfer potential for the amount of saturated density development using halftone toner patches of a single kind which are developed under an identical toner image forming condition. This case will be described as follows as the second embodiment.

The Second Embodiment

The second embodiment of a method for transfer voltage adjustment according to the present invention will be described with reference to the drawings. In this embodiment, the same components as those in the above embodiment will be allotted with the same reference numerals without description.

Figure 7:
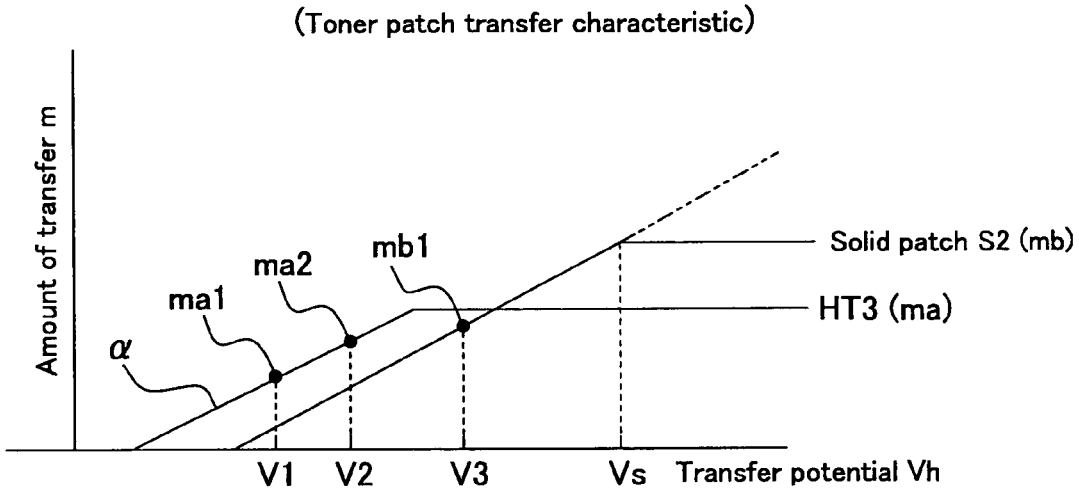
FIG. 7 is an illustrative chart showing a line segment approximation that represents the relationship between the amount of transferred toner and the transfer potential in the method for transfer voltage adjustment according to the second embodiment.

FIG. 7 is an illustrative chart showing a line segment approximation that represents the relationship between the amount of transferred toner and the transfer potential in the method for transfer voltage adjustment according to this embodiment.

The method for transfer voltage adjustment according to the present embodiment is performed in the same image forming apparatus as above.

As shown in FIG. 7, third halftone patches HT3 (which may be abbreviated as "patch HT3" in some cases) having an amount of development (amount of adhering toner) ma are formed on the photoreceptor under a fourth toner image forming condition. These patches having an amount of development ma each are partly transferred to transfer and conveyance belt 17 with application of unsaturated transfer voltages V1 and V2 so that the first and second unsaturatedly transferred halftone toner patches having amounts of toner, ma1 and ma2 will be formed on the belt.

Similarly, a solid toner patch S2 (which may be abbreviated as "patch S2" in some cases) having an amount of development mb is formed on the photoreceptor under a fifth toner image forming condition. This patch having an amount of development mb is partly transferred to transfer and conveyance belt 17 with application of an unsaturated transfer voltage V3 so that the unsaturatedly transferred solid toner patch having an amount of toner, mb1 will be formed on the belt.

The amounts of toner, ma1, ma2 and mb1 can be calculated based on the result of density detection of the transferred toner patches by density detecting sensor 1.

Also, the amounts of toner ma1 and ma2 satisfy the following relations. Here, $V_p$ and $V_t$ are the surface potential of the photoreceptor drum and the potential of the toner layer, respectively.

$$ma1=\alpha(V1-V_p+V_t)$$

$$ma2=\alpha(V2-V_p+V_t)$$

From this, the inclination α is determined as follows:

$$\alpha=(ma2-ma1)/(V2-V1)$$

As to the amount of toner mb1, the line segment approximation cutting through the point designated by (V3, mb1) and having an inclination of α can be assumed to represent the transfer characteristic of the solid pattern, so that the minimum saturated transfer potential Vs at which transfer will be saturated can be obtained as the following expression (G).

$$Vs=(mb-mb1)/\alpha+V3 \quad \text{(G)}$$

Next, the steps for determining the minimum saturated transfer potential Vs for mb, the amount of saturated density development, will be described.

To begin with, halftone patch HT3 is formed on photoreceptor drum 11*a* under the fourth toner image forming condition (Step 11).

Then, halftone patch HT3 is transferred to transfer and conveyance belt 17 with unsaturated transfer voltage V1 applied (Step 12).

The density of the first unsaturatedly transferred halftone toner patch is detected by density detecting sensor 1 (FIG. 1), and based on the result of density detection, the amount of toner, ma1, of the first unsaturatedly transferred halftone toner patch on transfer and conveyance belt 17 is calculated (Step 13).

Similarly, halftone patch HT3 is formed on photoreceptor drum 11*a* under the fourth toner image forming condition (Step 14).

Then, halftone patch HT3 is transferred to transfer and conveyance belt 17 with unsaturated transfer voltage V2 applied (Step 15).

The density of the second unsaturatedly transferred halftone toner patch is detected by density detecting sensor 1 (FIG. 1), and based on the result of density detection, the amount of toner, ma2, of the second unsaturatedly transferred halftone toner patch on transfer and conveyance belt 17 is calculated (Step 16).

Further, solid toner patch S2 having an amount of development mb is formed on the photoreceptor drum under the fifth toner image forming condition (Step 17).

Next, solid toner patch S2 is transferred to transfer and conveyance belt 17 with unsaturated transfer voltage V3 applied.

The amount of toner mb1 of the unsaturatedly transferred solid patch on transfer and conveyance belt 17 is calculated based on the result of density detection on the unsaturatedly transferred solid toner patch, detected by density detecting sensor 1 (Step 18).

It is not necessary to perform actual transferring to transfer and conveyance belt 17 for obtaining the amount of development mb of solid toner patch S2, and the amount of development mb, which is determined beforehand, can be used. For example, the amount of development, mb can be calculated based on the maximum density reference value stored for solid patch density correction (Step 19). It is also possible to calculate the amount of development mb by performing an actual operation of saturated transfer and detecting the transferred toner with density detecting sensor 1 (Step 20).

The order of the above steps is not limited. If some steps can be executed in parallel, they can be processed in parallel.

By substituting the amounts of toner, ma1, ma2 and mb1, mb, determined from the above processing steps and the unsaturated transfer voltages V1, V2 and V3, into the above expression (G), the minimum saturated transfer potential Vs for transferring the toner for the amount of saturated density development, mb. The thus obtained minimum saturated transfer potential Vs is the suitable transfer potential for the amount of saturated density development, mb.

With the above process, it is possible to determine the minimum saturated transfer potential Vs for the amount of saturated density development, mb, by using the line segment approximation having the same inclination as inclination α of the line segment derived based on the first amount of transferred toner, ma1 and the second amount of transferred toner ma2. Accordingly, it is possible to avoid application of a wasteful saturated transfer potential.

As described heretofore, according to the present embodiment, since the minimum saturated transfer voltage of the saturated density toner patch can be set up by using three toner patches as the reference patterns with a low consumption of toner, it is possible to provide stable toner images by use of the optimal transfer voltage without using wasted toner.

In the above first and second embodiments, setup of the minimum saturated transfer potential may be executed when it is determined that there is no recording medium such as paper or the like, for example.

Further, in the above first and second embodiments, it is possible to modify the setup condition for a low temperature and low humidity environment in such a manner that the minimum saturated transfer voltage is set at the normal level (100%) for plain paper and 10% higher (110%) for thick paper. On the other hand, it is possible to modify the setup condition for a high temperature and high humidity environment in such a manner that the minimum saturated transfer voltage is set 20% higher (120%) for plain paper and 30% higher (130%) for thick paper. This transfer voltage control makes it possible to realize stabilized image forming.

It should be noted that the present invention is not limited to the above embodiments, and various modifications can be added within the scope of the invention defined in the appended claims. That is, any embodied form obtained by combination of technical means that are appropriately modified without departing from the spirit and scope of the invention are intended to be embraced by the technology of the present invention.

What is claimed is:

1. A method for transfer voltage adjustment for use in an image forming apparatus in which a toner image formed on a toner image support is transferred to a transfer element with application of a transfer voltage, comprising the steps of:

forming a first halftone reference pattern on the toner image support under a first toner image forming condition;

transferring the first halftone reference pattern to the transfer element at the saturated density with application of a first saturated transfer voltage thereto;

calculating a first amount of adhering toner of the first halftone reference pattern on the transfer element;

forming a second halftone reference pattern on the toner image support under a second toner image forming condition;

transferring the second halftone reference pattern to the transfer element at the saturated density with application of a second saturated transfer voltage thereto;

calculating a second amount of adhering toner of the second halftone reference pattern on the transfer element;

acquiring a saturated amount of adhering toner when a density-saturated reference pattern is transferred to the transfer element at the saturated density, from previously stored data; and setting up a saturated transfer voltage for realizing the saturated amount of adhering toner, based on the first saturated transfer voltage, the first amount of adhering toner, the second saturated transfer voltage, the second amount of adhering toner and the saturated amount of adhering toner.

2. The method for transfer voltage adjustment according to claim 1, wherein the saturated amount of adhering toner is acquired by using a reference value of the saturated amount of adhering toner.

3. The method for transfer voltage adjustment according to claim 1, wherein a single toner density sensor is used for performing calculation of the first amount of adhering toner, the second amount of adhering toner and the saturated amount of adhering toner.

4. The method for transfer voltage adjustment according to claim 3, wherein the toner density sensor is able to detect the amount of toner remaining on the toner image support.

5. The method for transfer voltage adjustment according to claim 1, wherein the transfer element is a recording medium to which the toner image is transferred, further comprising the steps of:

detecting the presence of the recording medium;

executing the step of setting up the saturated transfer voltage when it is determined that there is no recording medium; and modifying the saturated transfer voltage, at least, in conformity with the usage environment under which the image forming apparatus is used or in conformity with the specifications of the recording medium.

6. An image forming apparatus, comprising:

a toner image support; and a transfer device for transferring a toner image formed on the toner image support to a transfer element with application of a transfer voltage, characterized in that the transfer device performs the processing steps of:

forming a first halftone reference pattern on the toner image support under a first toner image forming condition;

transferring the first halftone reference pattern to the transfer element at the saturated density with application of a first saturated transfer voltage thereto;

calculating a first amount of adhering toner of the first halftone reference pattern on the transfer element;

forming a second halftone reference pattern on the toner image support under a second toner image forming condition;

transferring the second halftone reference pattern to the transfer element at the saturated density with application of a second saturated transfer voltage thereto;

calculating a second amount of adhering toner of the second halftone reference pattern on the transfer element;

acquiring a saturated amount of adhering toner when a density-saturated reference pattern is transferred to the transfer element at the saturated density, from previously stored data; and setting up a saturated transfer voltage for realizing the saturated amount of adhering toner, based on the first saturated transfer voltage, the first amount of adhering toner, the second saturated transfer voltage, the second amount of adhering toner and the saturated amount of adhering toner.

* * * * *